US006514110B1

(12) United States Patent
Hirayama et al.

(10) Patent No.: US 6,514,110 B1
(45) Date of Patent: Feb. 4, 2003

(54) DEFLECTION YOKE ADJUSTMENT APPARATUS FOR A CATHODE RAY TUBE

(75) Inventors: Kazumasa Hirayama, Yokohama (JP); Maki Yoshida, Kitaadachi-gun (JP); Tatsuhiko Asaka, Konosu (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/471,474

(22) Filed: Dec. 23, 1999

(30) Foreign Application Priority Data

Dec. 25, 1998 (JP) ..... 10-370127

(51) Int. Cl.[7] ..... H01J 9/42
(52) U.S. Cl. ..... 445/3; 445/63
(58) Field of Search ..... 445/63, 3

(56) References Cited

U.S. PATENT DOCUMENTS 4,405,950 A * 9/1983 Wardell, Jr. ..... 445/63

FOREIGN PATENT DOCUMENTS

| | | |
|---|---|---|
| JP | 54-86232 | 7/1979 |
| JP | 2-168532 | 6/1990 |
| JP | 10-162741 | 6/1998 |

* cited by examiner

*Primary Examiner*—Kenneth J. Ramsey
*Assistant Examiner*—Joseph Williams
(74) *Attorney, Agent, or Firm*—Oblon, Spivak, McClelland, Maier & Neustadt, P.C.

(57) ABSTRACT

The adjustment apparatus automatically adjusts the position and angle of a deflection yoke attached to the neck part of a cathode ray tube. A cathode ray tube having a deflection yoke as an adjustment target attached to its neck part is fixed to a predetermined adjustment position such that its tube axis extends in the horizontal direction. The adjustment apparatus holds a deflection yoke attached to the neck part of the cathode ray tube fixed to an adjustment position by means of a hold mechanism. A test image displayed through a fluorescent surface of the cathode ray tube is picked up by a plurality of cameras. The deflection yoke held by the hold mechanism is moved based on image data picked up by the cameras. The position and angle of the deflection yoke with respect to the neck part are automatically adjusted.

14 Claims, 10 Drawing Sheets

DEFLECTION YOKE ADJUSTMENT APPARATUS FOR A CATHODE RAY TUBE

BACKGROUND OF THE INVENTION

The present invention relates to an adjustment apparatus for automatically adjusting the position and angle of a deflection yoke installed on a neck part of a cathode ray tube.

A neck part of a cathode ray tube is equipped with a deflection yoke for deflecting an electron beam, a plurality of purity convergence magnets (hereinafter called PC magnets) made of permanent magnets. To display a normal image through a fluorescent surface of the cathode ray tube, PC magnets are installed at appropriate positions with respect to the neck part, and the deflection yoke needs to be positioned at an appropriate position and an appropriate angle with respect to the neck part.

For example, when positioning the deflection yoke with respect to the neck part of the cathode ray tube, a test image is displayed through the fluorescent surface of the cathode ray tube. An operator then evaluates the convergence and purity and determines the rotation of the image with respect to the fluorescent surface, the vertical and horizontal positions thereof, and the distortion thereof, and manually adjust the position and angle of the deflection yoke so that a normal image is displayed properly.

When adjusting the deflection yoke, the deflection yoke is moved in the longitudinal direction along the tube axis of the cathode ray tube, the roll direction with the tube axis, the tilt direction in which the yoke is inclined upwards or downwards about the horizontal axis perpendicular to the tube axis, or the yawing direction in which the yoke is inclined leftwards and rightwards about the vertical axis perpendicular to the tube axis.

Known methods for adjusting the deflection yoke are a method in which a cathode ray tube mounting a deflection yoke on its neck part is loaded into a specialized adjuster device to adjust the yoke, a method in which a cathode ray tube mounted on a palette is conveyed to a predetermined adjustment position by a conveyer to adjust the yoke, and the like.

In any method, however, since an operator manually adjusts the position and angle of the deflection yoke while monitoring an image displayed through a fluorescent screen, the adjustment precision is low and lacks reliability so that satisfactory adjustment results cannot be obtained. Particularly, in conventional methods of manually adjusting the deflection yoke, there is a limitation in responding to images which have come to be finer and finer every year. Also, manual adjustment takes a longer time and burdens more heavily an operator, so that the deflection yoke cannot be securely adjusted in a short time.

BRIEF SUMMARY OF THE INVENTION

The present invention has been made in view of the above situation and has an object of providing an adjustment apparatus capable of automatically adjusting a deflection yoke attached to the neck part of a cathode ray tube to an appropriate position and an appropriate angle with high precision at a high speed.

To achieve the above object, a deflection yoke adjustment apparatus for a cathode ray tube according to the present invention comprises: detection means for detecting an image projected on the cathode ray tube; hold means for holding a deflection yoke attached to a neck part of the cathode ray tube; and adjustment means for moving the deflection yoke held by the hold means, based on a detection result depending on the detection means, thereby to automatically adjust a position and an angle of the deflection yoke with respect to the neck part.

Further, another deflection yoke adjustment apparatus for a cathode ray tube according to the present invention comprises: support means for supporting the cathode ray tube such that a tube axis of the cathode ray tube extends in a horizontal direction; detection means for detecting an image projected on the cathode ray tube supported by the support means; hold means for holding a deflection yoke attached to a neck part of the cathode ray tube supported by the support means; a slide mechanism for moving the deflection yoke held by the hold means, along the tube axis, based on a detection result obtained by the detection means; a rotation mechanism for rotating the deflection yoke held by the hold means, about the tube axis, based on the detection result obtained by the detection means; a tilt mechanism for rotating the deflection yoke held by the hold means, about a horizontal axis perpendicular to the tube axis, based on the detection result obtained by the detection means; and a yawing mechanism for rotating the deflection yoke held by the hold means, about a vertical axis perpendicular to the tube axis, based on the detection result obtained by the detection means.

Also, a deflection yoke adjustment method for a cathode ray tube according to the present invention comprises: a hold step of holding a deflection yoke attached to a neck part of the cathode ray tube arranged at a predetermined adjustment position; a detection step of detecting an image projected through the cathode ray tube; and a adjustment step of moving the deflection yoke held in the hold step, based on a detection result obtained by the detection step, thereby to automatically adjust a position and an angle of the deflection yoke with respect to the neck part.

Further, another deflection yoke adjustment method for a cathode ray tube comprises: a support step of supporting the cathode ray tube at a predetermined adjustment position such that a tube axis of the cathode ray tube extends in a horizontal direction; a hold step of holding a deflection yoke attached to a neck part of the cathode ray tube supported at the predetermined adjustment position in the support step; a detection step of detecting an image projected through the cathode ray tube; a slide step of moving the deflection yoke held in the hold step, along the tube axis, based on a detection result obtained in the detection step; a rotation step of rotating the deflection yoke held in the hold step, about the tube axis, based on the detection result obtained in the detection step; a tilt step of rotating the deflection yoke held in the hold step, about a horizontal axis perpendicular to the tube axis, based on the detection result obtained in the detection step; and a yawing step of rotating the deflection yoke held in the hold step, about a vertical axis perpendicular to the tube axis, based on the detection result obtained in the detection step.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

In the following, embodiments of the present invention will be specifically explained with reference to the drawings.

Figure 1:
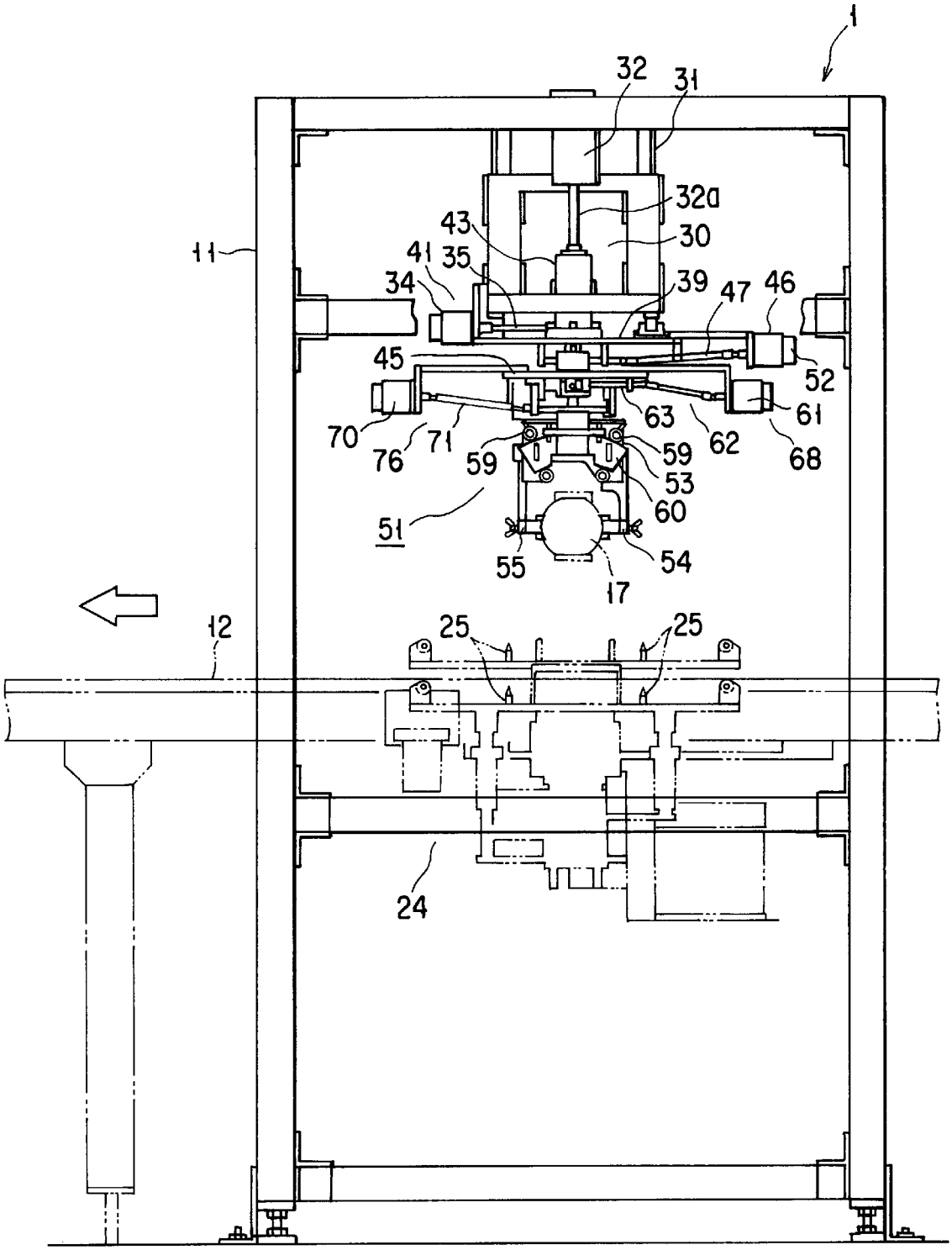
FIG. 1 is a front view showing the entire of an adjustment apparatus according to the present invention for automatically adjusting the position and angle of a deflection yoke attached to the neck part of a cathode ray tube.

FIG. 1 shows a schematic structure of a deflection yoke adjustment apparatus (hereinafter simply called an adjustment apparatus) 1 according to an embodiment of the present invention.

The adjustment apparatus 1 is equipped on an upper part of a substantially rectangular frame 11. A cathode ray tube equipped with a deflection yoke 17 as an adjustment target on its neck part, which is set on a palette not shown, is conveyed through the frame 11 by a conveyer 12.

Figure 2:
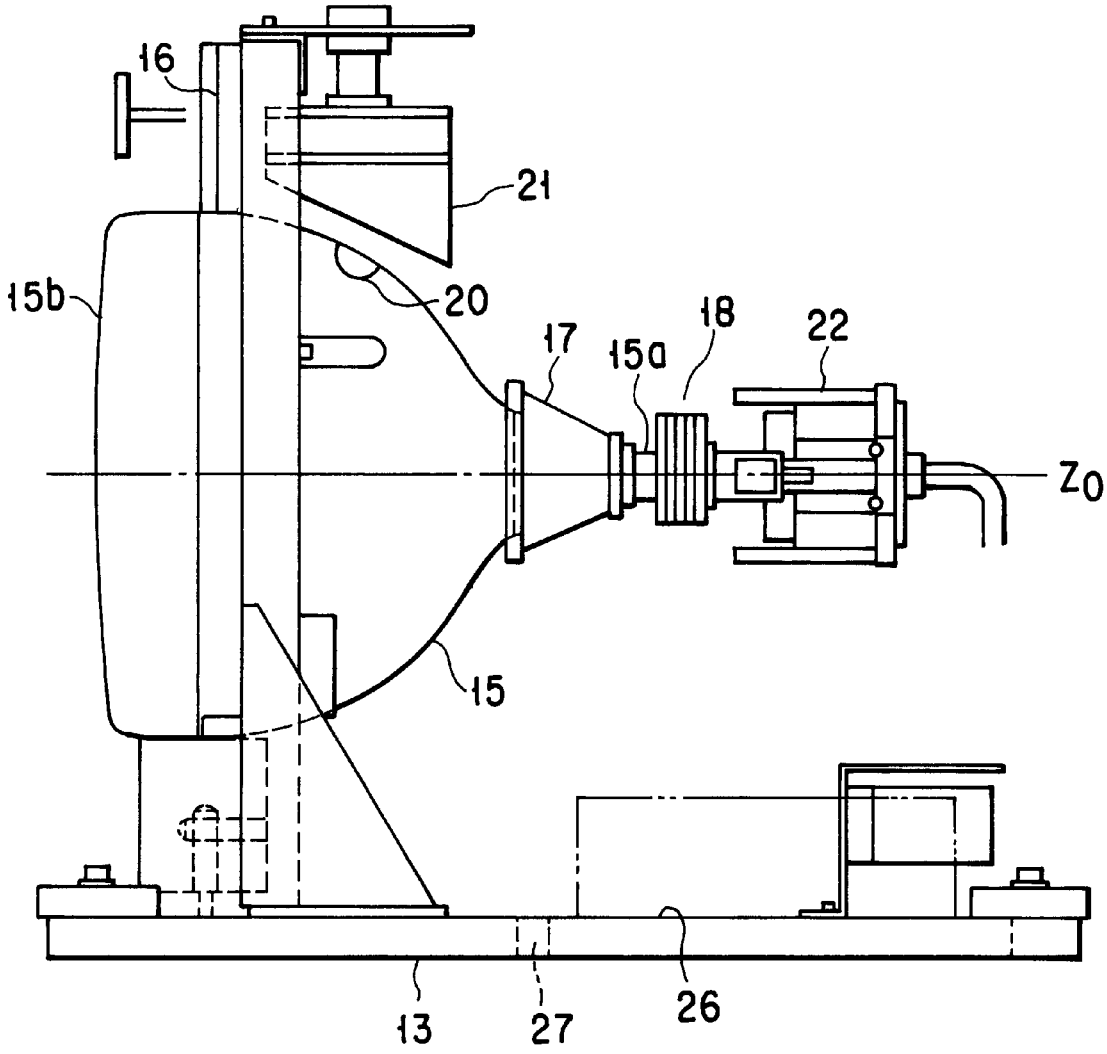
FIG. 2 is a side view showing a state where a cathode ray tube having a deflection yoke as an adjustment target attached to its neck part is loaded onto a palette.

FIG. 2 shows the palette 13 on which the cathode ray tube 15 is set. The cathode ray tube 15 is held and fixed by a support part 16 of the palette 13, which extends in a substantially vertical direction, such that the tube axis Z0 extends in the horizontal direction.

A deflection yoke 17 and a plurality of PC magnets 18 are equipped on the neck part 15*a* of the cathode ray tube 15 set on the palette 13, orderly from the face 15*b* side of the cathode ray tube 15. Also, the funnel of the cathode ray tube 15 is provided with an anode 20. In the palette 13 side, an anode contact 21 is provided to be opposed to this anode 20. The anode contact 21 is installed on an upper end of the support part 16. Further, the neck part 15*a* of the cathode ray tube 15 is connected with a socket 22.

Figure 9:
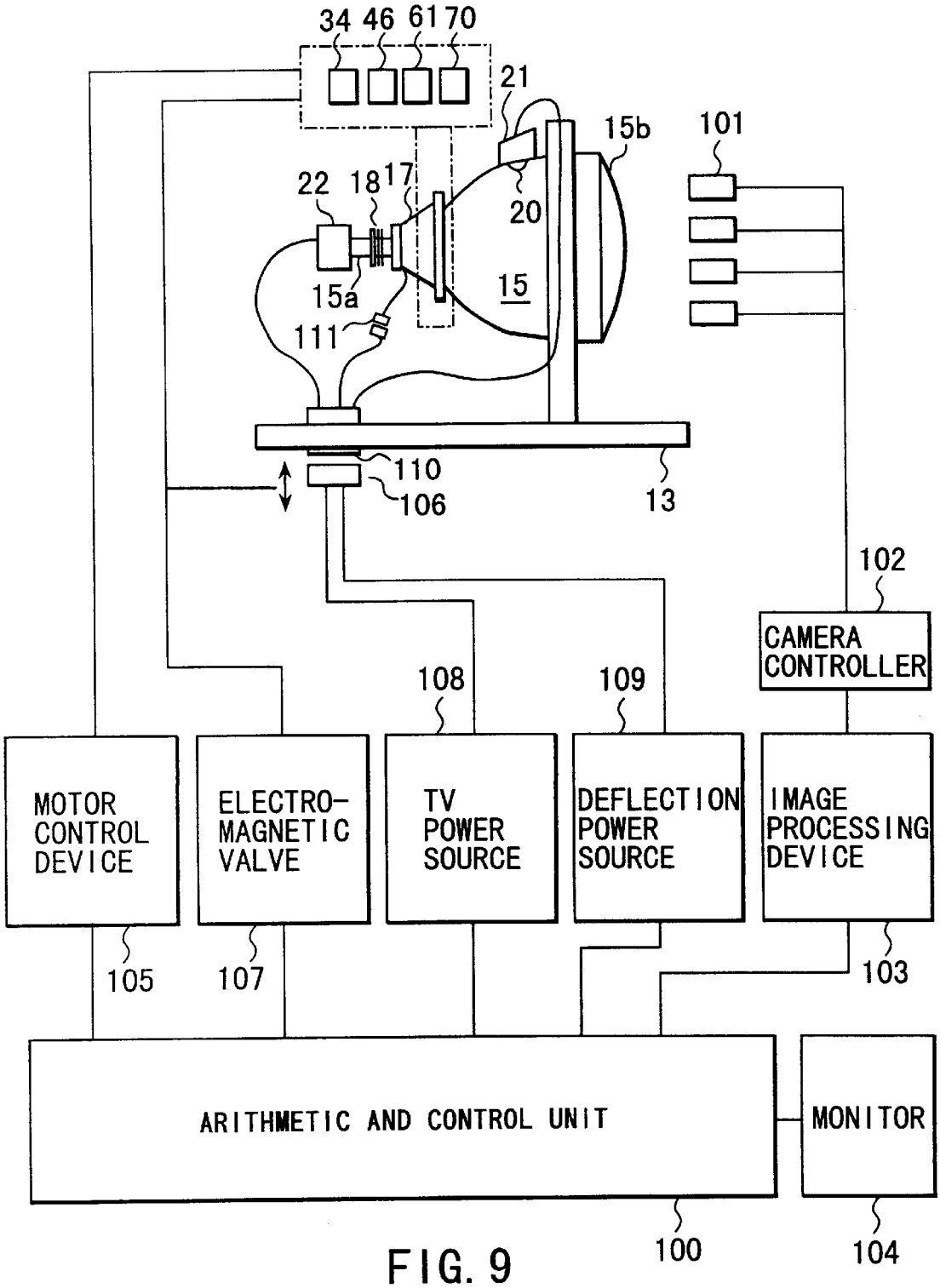
FIG. 9 is a block diagram showing a control system of an adjustment apparatus.

After the cathode ray tube 15 is set on the palette 13, the anode contact 21 and the socket 22 are electrically connected with corresponding parts of the cathode ray tube 15 (e.g., the anode 20 and neck part 15*a*). Also, a contact 110 (ref. FIG. 9) for electrically connecting a TV power source and a deflection power source described later with the palette 13 is provided at a lower portion of the palette 13. This contact 110 is electrically connected with the anode contact 21, the socket 22, and the deflection yoke 17.

As shown in FIG. 1, a palette hold device 24 is provided at a predetermined position of a lower portion of the conveyer 12. The palette hold device 24 has a plurality of hold pins 25 on its upper surface part and an air cylinder not shown for elevating upwards the hold pins 25. When the palette 13 which mounts the cathode ray tube 15 is conveyed to a predetermined adjustment position in the frame 11 through the conveyer 12, the conveyer 12 is stopped and the air cylinder is driven to elevate upwards the hold pins 25. The plurality of hold pins 25 of the palette hold device 24 are respectively engaged in the plurality of holes 27 provided in a bottom plate part 26 of the palette 13 conveyed to the adjustment position, and the palette 13 is fixed to the predetermined adjustment position independently from the conveyer 12.

In FIG. 1, the arrow indicates the conveyance direction of the palette 13 based on the conveyer 12. Although FIG. 1 does not show the palette 13 itself, this figure shows a state in which the palette 13 not shown is installed on the adjustment apparatus 1 such that the neck part 15*a* of the cathode ray tube 15 set on the palette 13 is oriented to the near side along the direction vertical to the paper surface of the figure.

In the following explanation, the direction vertical to the paper surface of FIG. 1 which is the longitudinal direction along the tube axis Z0 of the cathode ray tube 15 set at the adjustment position is defined as a Z-direction. The conveyance direction of the palette 13 in FIG. 1 which is a horizontal direction X-X perpendicular to the tube axis Z0 of the cathode ray tube 15 is defined as an X-direction, and the vertical direction Y-Y perpendicular to the tube axis Z0 of the cathode ray tube 15 is defined as a Y-direction.

The adjustment apparatus 1 installed on the frame 11 serves to adjust the position and angle of the deflection yoke 17 attached to the neck part 15*a* of the cathode ray tube 15 set at the predetermined adjustment position as described above. The following will explain specifically the adjustment apparatus 1.

Figure 3:
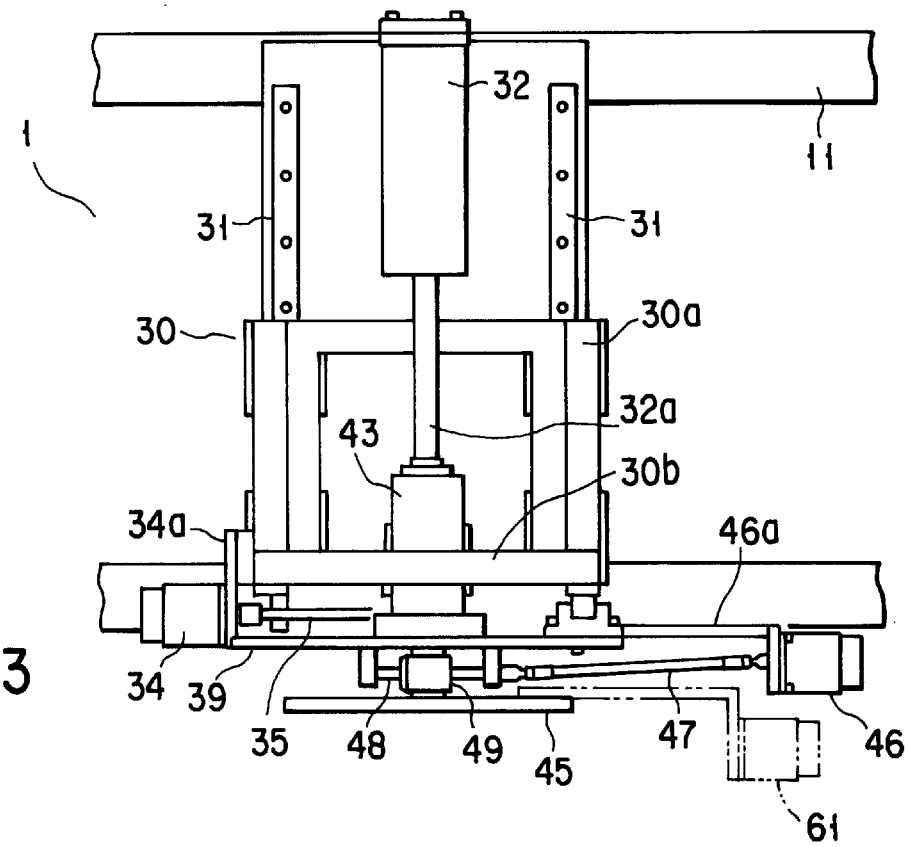
FIG. 3 is a front view mainly showing a mechanism for elevating up and down the elevation base of the adjustment apparatus of FIG. 1 and a yawing mechanism for rotating the deflection yoke about a vertical axis.
Figure 4:
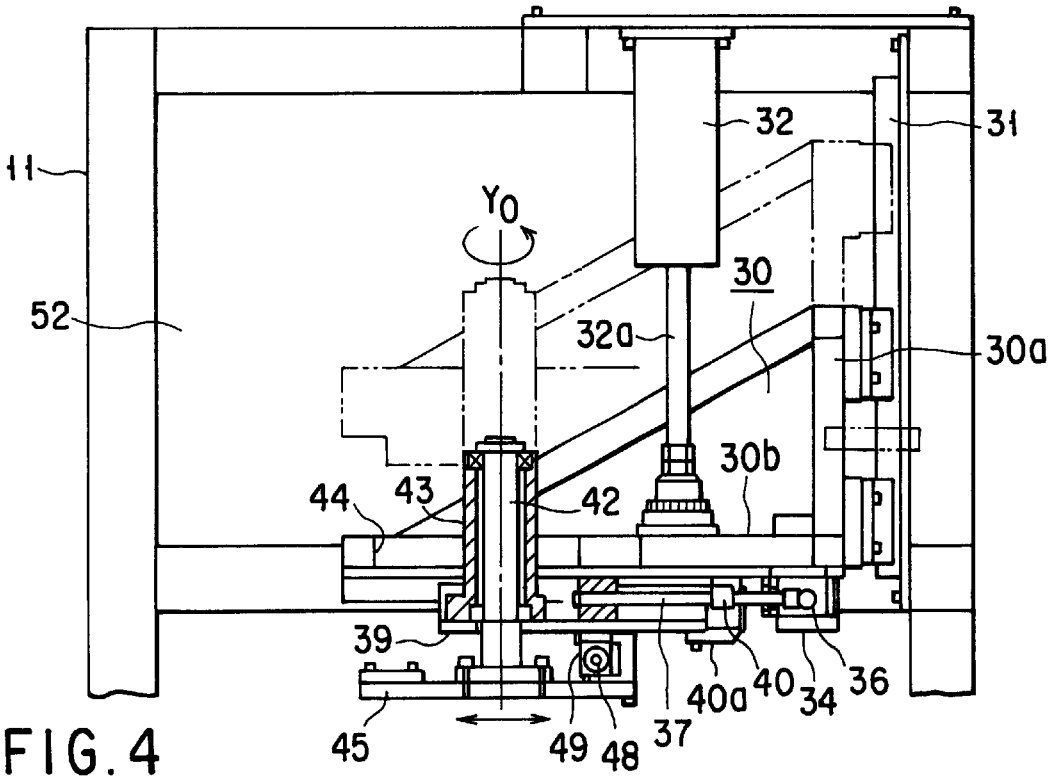
FIG. 4 is a side view showing the mechanism of FIG. 3.

As shown in FIGS. 3 and 4, the adjustment apparatus 1 has an elevation base 30 which is attached to slide rails 31 installed at an upper portion of the frame 11 such that the base can be elevated up and down. The elevation base 30 has a vertical part 30*a* and a horizontal part 30*b* which are connected to each other such that the parts are perpendicular to each other. The vertical part 30*a* is slidably held on the slide rails 31. The horizontal part 30*b* is connected with an operation rod 32*a* of the air cylinder 32 installed at an upper portion of the frame 11. Thus, the elevation base 30 is elevated along the slide rails 31 by operating the air cylinder 32.

Figure 5:
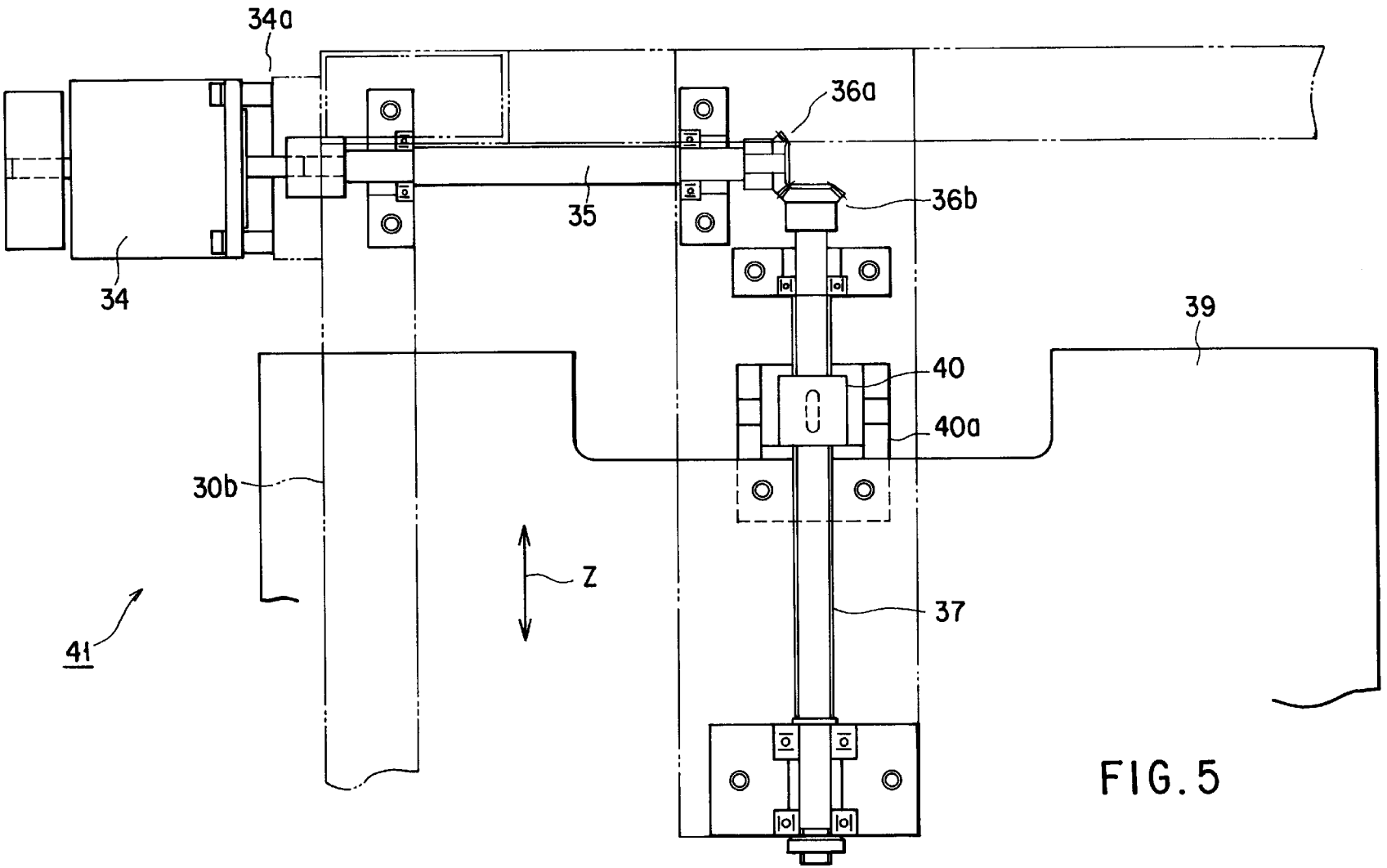
FIG. 5 is a plan view showing a slide mechanism for sliding the deflection yoke in the tube axis direction.
Figure 11:
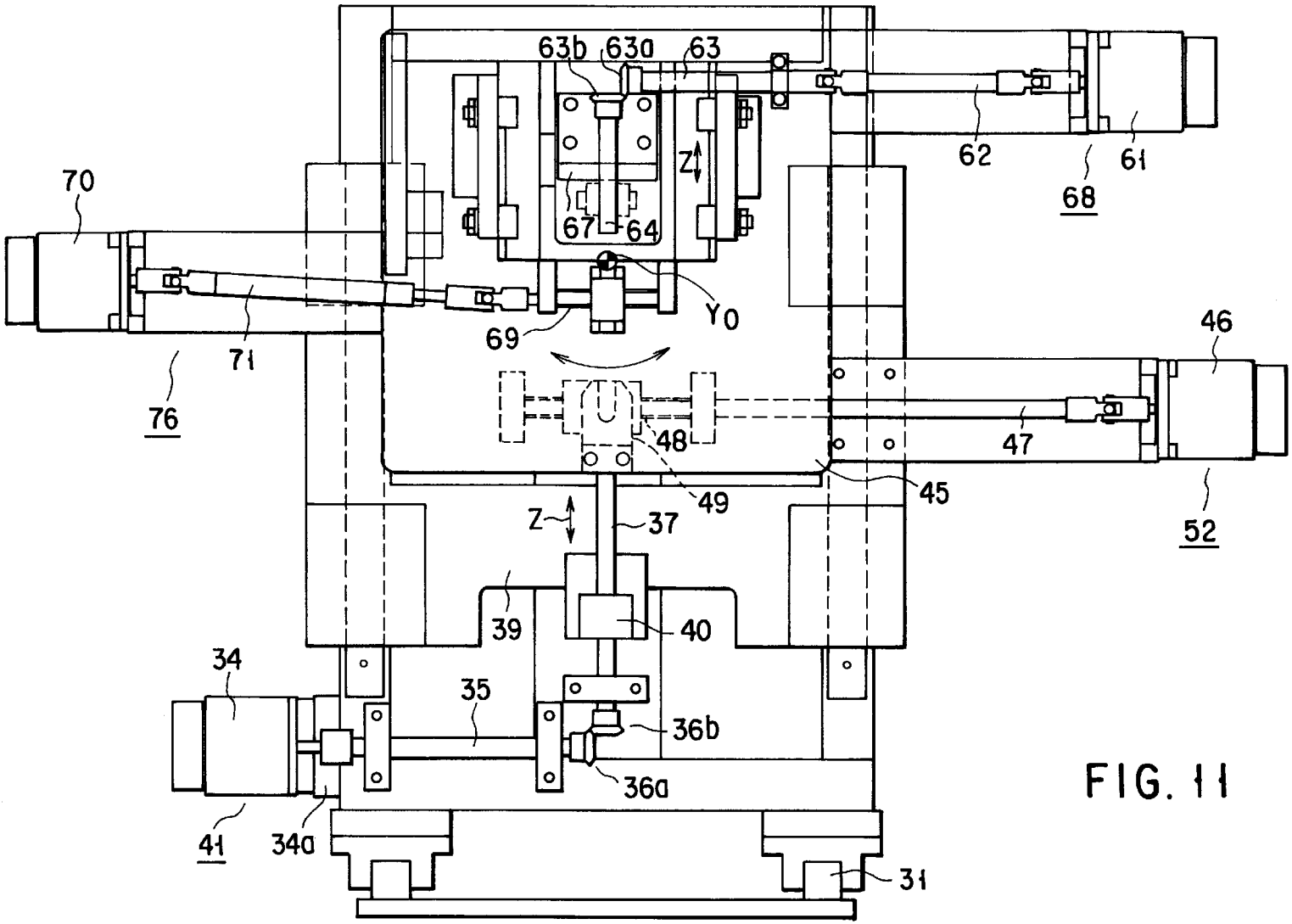
FIG. 11 is a plan view of the slide mechanism shown in FIG. 5, as viewed from below.

FIGS. 5 and 11 specifically show the structure of a slide mechanism 41 for moving the deflection yoke 17 along the tube axis Z0.

As shown in FIGS. 3, 4, and 5, a motor 34 of the slide mechanism 41 is attached to the horizontal part 30 of the elevation base 30 through a bracket 34*a*. A shaft 35 extending in the X-direction is connected to the rotation shaft of the motor 34. A screw 37 is connected to the top end of the shaft 35 through a pair of bevel gears 36*a* and 36*b* which are provided to be perpendicular to each other. That is, the screw 37 extends in the Z-direction.

Meanwhile, a plate-like slide base 39 is attached to the lower end of the horizontal part 30*b* such that the base is slidable on the horizontal part 30*b* in the Z-direction. A female screw 40 to be screwed on the screw 37 is attached, through a bracket 40*a,* to an end of the slide base 39 along the Z-direction of the slide base 39.

Accordingly, when the motor 34 of the slide mechanism 41 is rotated, a drive force is transmitted through the shaft 35 and the pair of bevel gears 36*a* and 36*b,* and the screw 37 is rotated. As the screw 37 rotates, the female screw 40 screwed on the screw 37 moves in the Z-direction, and the slide base 39 moves in the Z-direction with respect to the elevation base 30.

Next explanation will be made of a yawing mechanism 52 for rotating the deflection yoke 17 about the vertical axis Y0 perpendicular to the tube axis Z0.

As shown in FIGS. 3 and 4, a support cylinder 43 which rotatably supports the rotation shaft 42 of the yawing mechanism 52 provided so as to extend in the Y-direction is provided so as to stand integrally on the slide base 39 of the slide mechanism 41. A elongated hole 44 extending in the Z-direction, which allows the support cylinder 43 to move in the Z-direction, is formed in the horizontal part 30*b* of the elevation base 30. The rotation shaft 42 has a rotation axis Y0 which moves in the Z-direction in accordance with movement of the slide base 39.

A rotation base 45 which rotates along the horizontal surface is integrally installed at the lower end of the rotation shaft 42. Meanwhile, the slide base 39 is equipped with a motor 46 for rotating the rotation base 45, through a relatively long bracket 46*a,* such that the motor 46 is apart from the slide base 39. The rotation shaft of the motor 46 is connected with a screw 48 provided so as to extend in the X-direction, through a thin long joint 47 extending substantially in the X-direction. Further, a female screw 49 screwed on the screw 48 is fixed to the upper surface of the rotation base 45, deviated from the rotation center thereof.

Figure 7:
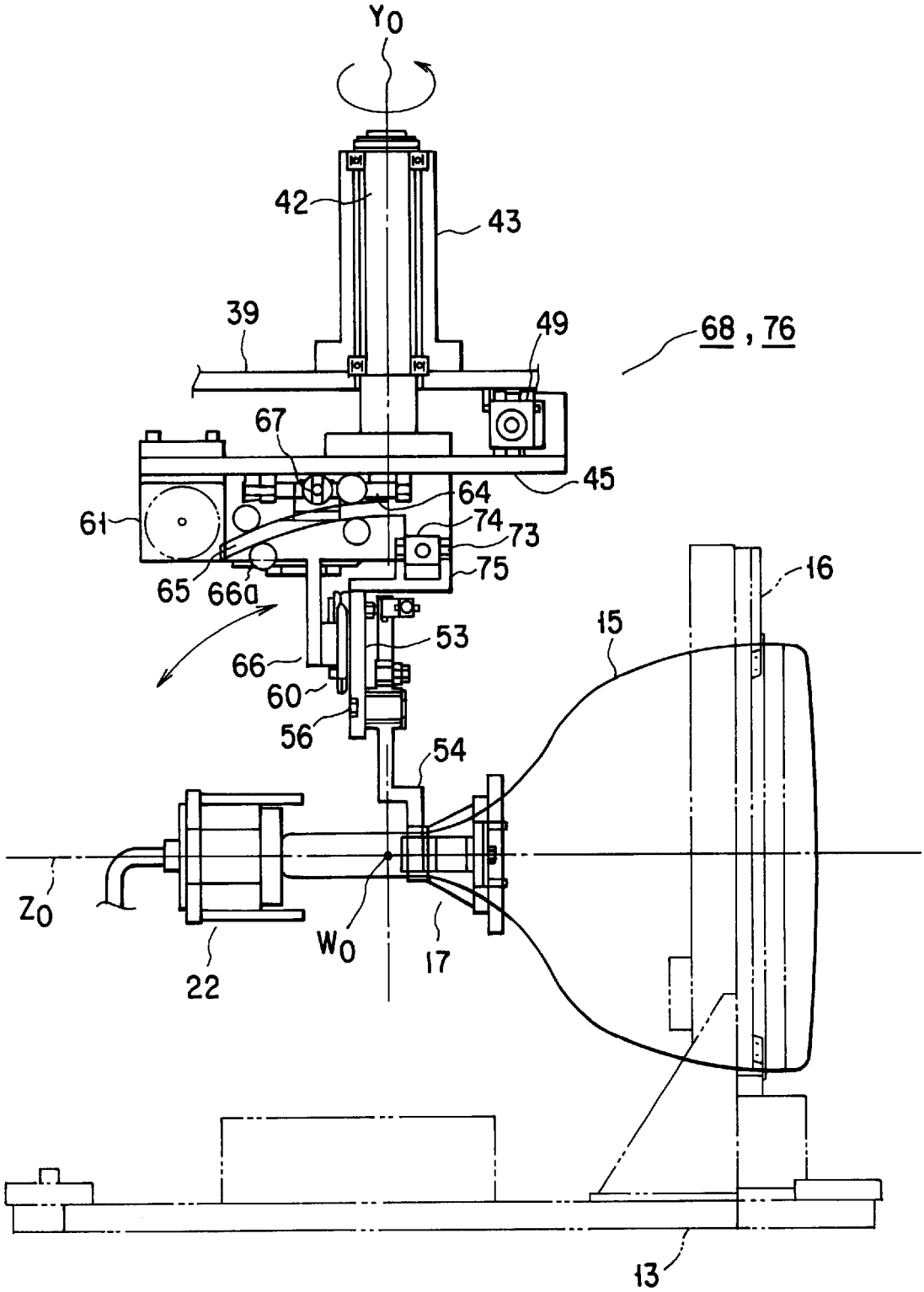
FIG. 7 is a side view mainly showing a tilt mechanism for rotating the deflection yoke about a horizontal axis.

Accordingly, when the motor 45 is rotated, a drive force is transmitted through the joint 47, and the screw 48 rotates. As the screw 48 rotates, the female screw 49 engaged with the screw 48 moves in the X-direction, and the rotation base 45 is rotated in a predetermined direction about the rotation axis Y0 with respect to the slide base 39. Note that the rotation axis Y0 of the rotation is set at the position of the tube axis Z0 of the cathode ray tube 15 where the tube crosses the tube axis Z0. Also, the point where the tube axis Z0 and the rotation axis Y0 cross each other is the adjustment reference point W0 of the deflection yoke 17 (ref. FIG. 7).

Explained next will be a hold mechanism 51 for holding the deflection yoke 17 attached to the neck part 15*a* of the cathode ray tube 15 set at an adjustment position.

Figure 6:
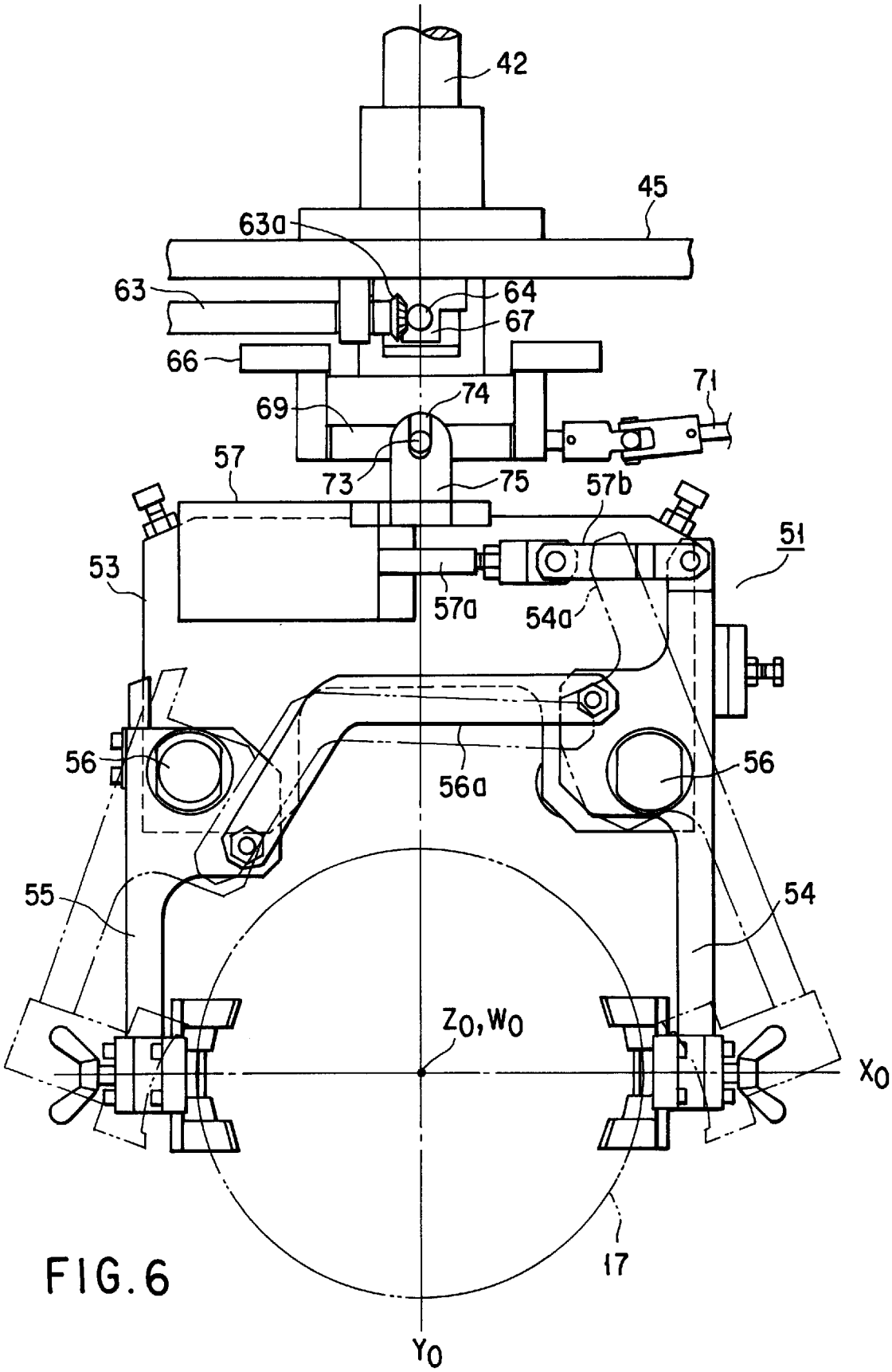
FIG. 6 is a front view mainly showing a hold mechanism for holding the deflection yoke.

As shown in FIG. 6, the hold mechanism 51 is provided below the rotation base 45 of the yawing mechanism 52 described above and has a plate-like base 53 extending along the surface perpendicular to the tube axis Z0 of the cathode ray tube 15. FIG. 6 shows a view of the hold mechanism 51 viewed from the side of the face surface 15*b* of the cathode ray tube 15.

A pair of chucks 54 and 55 are respectively attached to the lower end of the base 53 through a pin 56, respectively. A link arm 56*a* connecting the pair of chucks 54 and 55 is attached to those portions of the chucks 54 and 55 that are deviated from the rotation centers of the chucks. This link arm 56*a* functions to rotate the chuck 55 in an opposite direction, linked with rotation of the chuck 54.

An air cylinder 57 for opening/closing the chucks 54 and 55 is attached to the base 53. A rear end 54*a* which is distant from the pin 56 of the chuck 54 is rotatably connected to the top end of the operation rod 57*a* of the air cylinder 57 through the connection member 57*b*.

Accordingly, when the air cylinder 57 of the hold mechanism 51 is operated, a drive force is transmitted through the operation rod 57*a* and the connection member 57*b,* and the rear end 54*a* of the chuck 54 is rotated about the pin 56 as the center. As one chuck 54 rotates, a drive force is transmitted to the other chuck 55 through the link arm 56*a* so that the pair of chucks 54 and 55 are opened/closed. With the pair of chucks 54 and 55 rotated to a hold position indicated by continuous lines in FIG. 6, the deflection yoke 17 is clamped from the left and right sides by the top ends of the chucks 54 and 55.

Next, explanation will be made of a tilt mechanism 68 for rotating the deflection yoke 17 held by the hold mechanism 51, about the horizontal axis X0 which penetrates through the adjustment reference point W0 described above and is perpendicular to the tube axis Z0.

As shown in FIG. 7, the tilt mechanism 68 has a plate cam 65 fixed to the lower surface side of the rotation base 45 of the yawing mechanism 52 described above. The plate cam 65 is formed in an arc-like shape whose center is the adjustment reference point W0 and extends in the substantial Z-direction. A connection member 66 comprising a plurality of cam followers 66*a* is installed on the plate cam 65 such that the connection member 66 can swing freely. Also, the base 53 of the hold mechanism 51 is fixedly installed on the connection member 66 through a cam mechanism described later. Accordingly, the base 53 of the hold mechanism 51 can swing about the adjustment reference point W0 along the plate cam 65.

Figure 8:
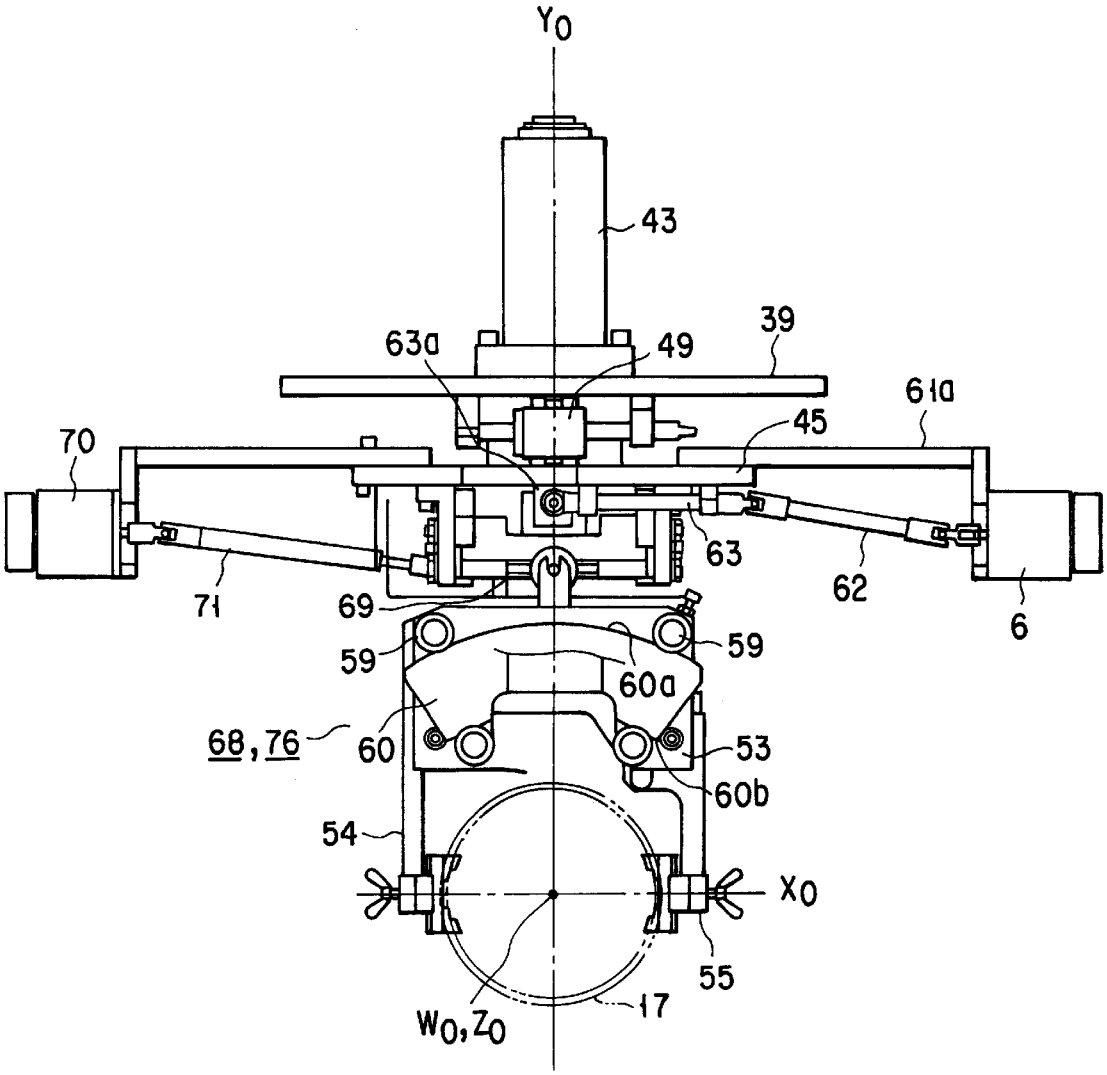
FIG. 8 is a front view mainly shows a rotation mechanism for rotating the deflection yoke about the tube axis.

As shown in FIG. 8, the tilt mechanism 68 comprises a motor 61 for swinging the connection member 66. The motor 61 is installed on the rotation base 45 through a relatively elongated bracket 61*a*. A joint 62 extending in the substantial X-direction and a shaft 63 extending in the X-direction are connected orderly to the rotation shaft of the motor 61. A screw 64 (FIGS. 6 and 7) extending in the Z-direction through a pair of bevel gears 63*a* and 63*b* is connected to the end of the shaft 63, which is distant from the motor 61. Further, a female screw 67 fixed to a connection member 66 is screwed on the screw 64.

Accordingly, when the motor 61 of the tilt mechanism 68 is rotated, a drive force is transmitted through a joint 62, a shaft 63, and a pair of bevel gears 63*a* and 63*b,* thereby rotating the screw 64. As the screw 64 rotates, the female screw 67 slides in the Z-direction and the connection member 66 moves along the plate cam 65. The base 53 of the hold mechanism 51 holding the deflection yoke 17 is thereby moved, and the deflection yoke 17 is rotated in the tilting direction about the adjustment reference point W0 as its center.

Next, explanation will be made of a rotation mechanism 76 which rotates the deflection yoke 17 held by the hold mechanism 51 about the tube axis Z0.

As shown in FIGS. 7 and 8, the rotation mechanism 76 has a cam plate 60 fixed to the lower end of the connection member 66 of the tilt mechanism 68. The cam plate 60 is formed in a substantially sectorial shape having an upper end edge 60*a* and a lower end edge 60*b,* which is an arc with respect to the adjustment reference point W0 described above as the center, and is provided along a surface perpendicular to the tube axis Z0. The upper end edge 60*a* and the lower end edge 60*b* of the cam plate 60 are engaged with four cam followers 59 projected from the base 53 of the hold mechanism 51 described above, and the base 53 is held rotatably about the adjustment reference point W0 by the cam plate 60.

Also, the rotation mechanism 76 has a motor 70 for rotating the base 53 about the tube axis Z0. The motor 70 is installed through a relatively elongated bracket 70*a* on the rotation base 45 of the yawing mechanism 52. A screw 69 extending in the X-direction is connected to the rotation shaft of the motor 70-through a shaft 71 extending in the substantial X-direction. Both ends of the screw 69 are rotatably attached to the connection member 66. A female screw 74 having a pair of pins 73 is engaged on the screw 69. Further, U-shaped grooves of an operation member 75 projected from the upper end of the base 53 are engaged with the paired pins 73 from the downside.

Accordingly, when the motor 70 of the rotation mechanism 76 is rotated, a drive force is transmitted through the shaft 71 thereby rotating the screw 69. AS the screw 69 rotates, the female screw 74 engaged with the screw 69 moves in the X-direction along the screw 69, and the base 53 of the hold mechanism 51 is let swing about the adjustment reference point W0 with respect to the cam plate 60.

According to the adjustment apparatus 1, the deflection yoke 17 held by the hold mechanism 51 is adjusted in the following four directions with respect to the neck part 15*a* of the cathode ray tube 15 set at the adjustment position. The deflection yoke 17 rotates firstly about the tube axis Z0 (which is the adjustment reference point W0) by rotating the motor 70 of the rotation mechanism 76, secondly about the horizontal axis X0 (which is the adjustment reference point W0) by rotating the motor 61 of the tilt mechanism 68, and thirdly about the vertical axis Y0 (which is the adjustment reference point W0) by rotating the motor 46 of the yawing mechanism 52. That is, these first to third rotations are achieved around the adjustment reference point W0. The deflection yoke 17 fourthly slides along the tube axis Z0 by rotating the motor 34 of the slide mechanism 41, sliding the slide base 39 in the Z-direction, and moving the adjustment reference point W0 along the tube axis Z0.

In the present embodiment, servomotors such as pulse motors are used as motors 34, 46, 61, and 70 for driving respective mechanisms thereby to eliminate influences onto the magnetic field from the motors. The motors are therefore arranged at positions apart from the deflection yoke 17. In the present embodiment, the motors 34, 46, 61, and 70 are arranged apart from the tube axis Z0 at least by 300 nm or more.

Meanwhile, if the mechanisms 41, 52, 68, and 76 are operated about a point deviated from the adjustment reference point W0 described above, the electron beam moves with different deviation components when a test image is displayed through the fluorescent surface of the cathode ray tube. Therefore, the deflection yoke 17 cannot be adjusted to a correct position and angle. In several cases, positioning of the deflection yoke may be completed by repeating trial and error but takes a long time thereby leading to low productivity. Therefore, in the present invention, respective mechanisms are operated about the adjustment reference point W0 described above as the center.

Next, the control system for controlling operation of the adjustment apparatus 1 will be explained with reference to the block diagram shown in FIG. 9.

The control system of the adjustment apparatus 1 has an arithmetic and control unit 100 which performs various calculations and controls operations of the respective mechanisms.

The arithmetic and control unit 100 is connected with an image processing device 103 to which a plurality of cameras 101 are connected through a camera controller 102. The plurality of cameras 101 are provided at positions where the cameras face the face su 15*b* of the cathode ray tube 15 which is mounted on the palette 13 and set at a predetermined adjustment position. In addition, the arithmetic and control unit 100 is connected with a monitor 104 for displaying measurement results based on video signals obtained through the plurality of cameras 101.

Also, the arithmetic and control unit 100 is connected with the motors 34, 46, 61, and 70 of the mechanisms 41, 52, 68, and 76 through the motor control device 105.

Also, the arithmetic and control unit 100 is connected with a plurality of electromagnetic valves 107 for operating an air cylinder not shown for moving up the plurality of hold pins 25 of the palette hold mechanism 24 described above, an air cylinder 32 for elevating up and down the elevation base 30 of the adjustment device 1, an air cylinder 57 for opening/closing the pair of chucks 54 and 55 of the hold mechanism 51, and an air cylinder not shown for moving up the contact 106 toward the contact 110 attached to the palette 13.

Further, the arithmetic and control unit 100 is connected with a TV power source 108 and a deflection power source 109. The power sources 108 and 109 are electrically connected to the contact 110 of the palette 13 through the contact 106.

Accordingly, the power sources 108 and 109 apply predetermined electric signals to the neck part 15*a* of the cathode ray tube 15, the deflection yoke 17, and the anode 20, through the socket 22, connector 111, and anode contact 21, thereby to display a predetermined test image on the fluorescent surface of the cathode ray tube 15.

Next, explanation will be made of adjustment operation of the deflection yoke 17 by the adjustment apparatus 1 constructed as described above.

At first, prior to adjustment operation, an operator loads the cathode ray tube 15 equipped with the deflection yoke 17 as an adjustment target and the PC magnets 18, onto the palette 13, in a loading section not show along the conveyer 12. Further, the operator inserts the socket 22 into the neck part 15*a* of the cathode ray tube 15, connects the connector 111 of the deflection yoke 17, and inserts the anode contact 21 into the anode 20. Further, the palette 13 onto which the cathode ray tube 15 has been loaded is conveyed through the conveyer 12. When the palette 13 comes to a predetermined adjustment position, the conveyer 12 is stopped.

Thereafter, the arithmetic and control unit 100 of the adjustment apparatus 1 operates the cylinder of the palette hold device 24, which is not shown, and the plurality of hold pins 25 are moved up to penetrate through the holes of the palette 13. The palette 13 is thus fixed to the adjustment position.

In this situation, the arithmetic and control unit 100 operates the air cylinder 32 of the adjustment device 1 to move down the adjustment apparatus to a predetermined position. Further, the air cylinder 57 of the hold mechanism 51 is operated to hold the deflection yoke 17 attached to the neck part 15*a* of the cathode ray tube 15 by a pair of chucks 54 and 55. At the same time, the air cylinder not shown for moving up the contact 106 is operated thereby to connect the contact 106 with the contact 110 of the palette 13. Further, various electric signals are applied to the cathode ray tube 15 through the TV power source 108 and the deflection power source 109, and a predetermined test image is displayed through the fluorescent surface.

Further, the test image displayed through the fluorescent surface is picked up through a plurality of cameras 101, and the picked image data is inputted to an image processing device 103 through the camera controller 102. The arithmetic and control unit 100 calculates a displacement of the raster rotation, a displacement of the purity, and a displacement of the convergence, based on the image data processed by the image processing device 103.

The arithmetic and control unit 100 operates respective mechanisms of the adjustment apparatus 1 based on the displacements calculated as described above, and adjusts the position and angle of the deflection yoke 17 with respect to the neck part 15*a* of the cathode ray tube 15.

The calculation device 100 firstly adjusts the cutoff of the cathode ray tube 15. The calculation device 100 thereafter controls the motor control device 105, based on the displacement of the raster rotation, and drives the motor 70 of the rotation mechanism 76. In this manner, the deflection yoke 17 rotates about the tube axis Z0 thereby to adjust automatically the raster rotation.

In addition, the arithmetic and control unit 100 controls the motor control device 105 based on the calculated displacement of the purity, and drives the motor 34 of the slide mechanism 41. In this manner, the deflection yoke 17 slides in the direction of the tube axis Z0, and the purity is automatically adjusted. When adjusting the purity, the measurement value of the purity is displayed through the monitor 104, and two-pole PC magnets 18 are adjusted by the operator.

Further, the arithmetic and control unit 100 controls the motor control device 105 based on the calculated displacement of the convergence, and drives the motor 61 of the tilt mechanism 68 and the motor 46 of the yawing mechanism 52. By driving the motor 61 of the tilt mechanism 68, the deflection yoke 17 is rotated about the horizontal axis X0 which penetrates through the adjustment reference point W0, as the center. By driving the motor 46 of the yawing mechanism 52, the deflection yoke 17 is rotated about the vertical axis Y0 which penetrates through the adjustment reference point W0, as the center. The convergence is thereby automatically adjusted. When adjusting the convergence, the measurement value of the convergence is displayed through the monitor 104, and four-pole or six-pole PC magnets 18 are adjusted by the operator.

Upon completion of the adjustment operation, the arithmetic and control unit 100 operates the air cylinder 57 to open the chucks 54 and 55, and release the hold of the deflection yoke 17. Further, the air cylinder 32 is operated to move up the adjustment apparatus 1. Thereafter, the air cylinder not shown is operated to move down the hold pins 25 of the palette hold device 24 and the contact 106. Further, the conveyer 12 is let travel to convey the palette 13 to a processing step in the downstream side.

As described above, the adjustment apparatus 1 according to the present embodiment includes a slide mechanism 41 for sliding the deflection yoke 17 attached to the neck part 15*a* of the cathode ray tube 15, in the tube axis Z0 direction, a rotation mechanism 76 for rotating the yoke 17 about the tube axis Z0, a tilt mechanism 68 for rotating the yoke 17 about the horizontal axis X0 perpendicular to the tube axis Z0, and a yawing mechanism 52 for rotating the yoke 17 about the vertical axis Y0 perpendicular to the tube axis Z0. In this manner, the position and angle of the deflection yoke 17 can be automatically adjusted with respect to the neck part 15*a,* and the time required for adjustment can be shortened, so that the deflection yoke 17 can be precisely positioned with respect to the neck part 15*a*. Also, according to the present embodiment, the deflection yoke 17 can be adjusted automatically so that the reliability can be improved with respect to the adjustment results.

Next, another embodiment of the present invention will be explained with reference to FIG. 10.

Figure 10:
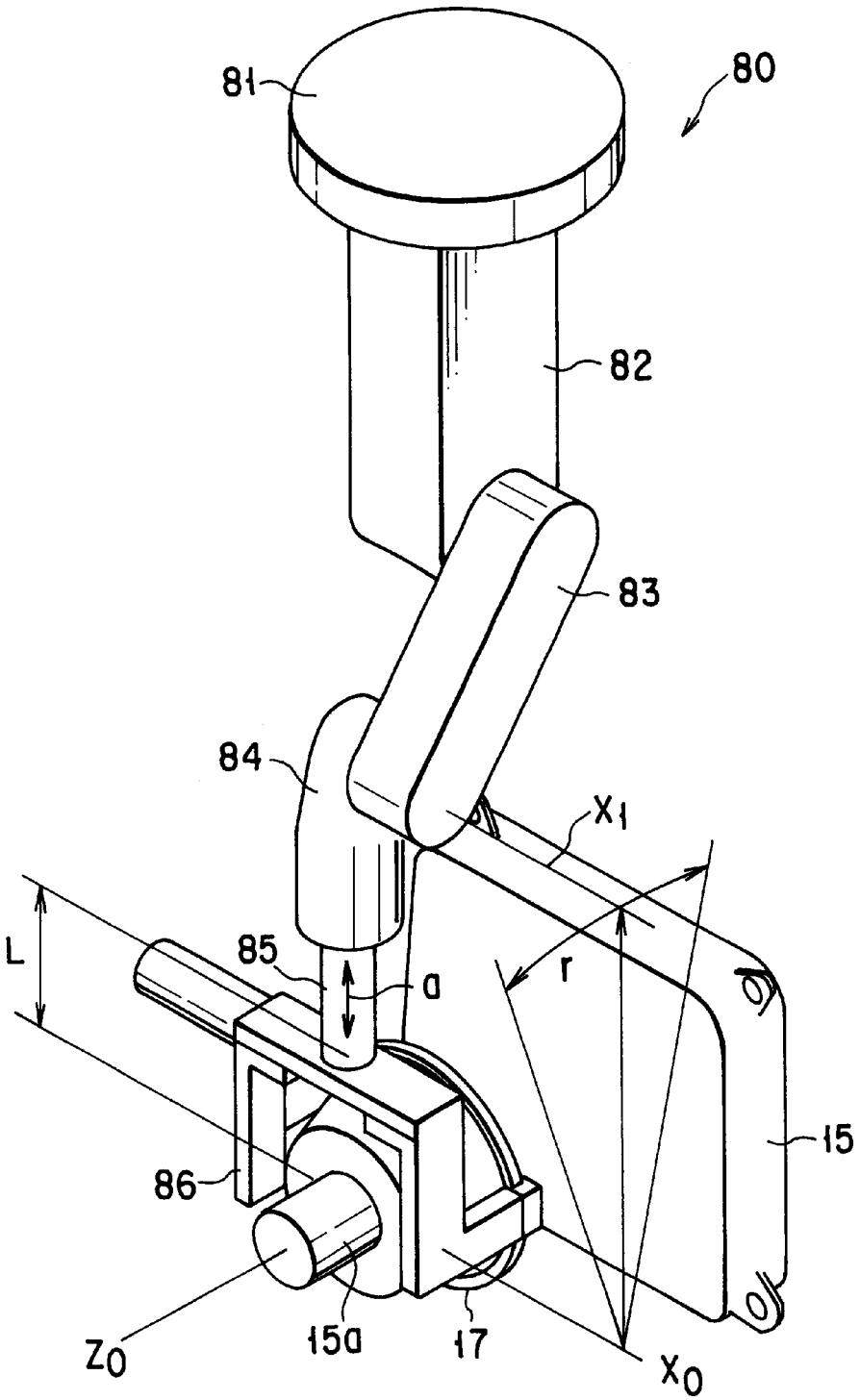
FIG. 10 is a perspective view showing an adjustment apparatus according to another embodiment of the present invention.

FIG. 10 shows a perspective view of an adjustment apparatus 80 which holds the deflection yoke 17 attached to the neck part 15*a* of the cathode ray tube 15 loaded onto the palette 13 with use of a multiarticular robot, to position the yoke 17 with respect to the neck part 15*a*.

This adjustment apparatus 80 has a rotation member 81 provided to be rotatable about the axis extending in the vertical direction. This rotation member 81 is held movably at an arbitrary position by a mechanism not shown.

In the lower surface side of the rotation member 81, a support member 82 extends in the substantially vertical direction and is integrally projected. The base end portion of the operation arm 84 is rotatably connected to the lower end of the support member 82 through the arm 83. The hold member 86 which holds the deflection yoke 17 is attached to the top end of the operation rod 85 which expands and contracts in the arrow direction a of the operation arm 84.

The adjustment apparatus 80 thus constructed is capable of adjusting the deflection yoke 17 in all directions about the adjustment reference point W0 (not shown) where the tube axis Z0 and the horizontal axis X0 cross each other. That is, the adjustment apparatus 80 according to the present embodiment performs the same functions as those of the slide mechanism 41, the rotation mechanism 76, the tilt mechanism 68, and the yawing mechanism 52 of the adjustment apparatus 1 described above.

For example, if the adjustment apparatus 80 is used to rotate the deflection yoke 17 about the horizontal axis X0, the deflection yoke 17 is tilted while maintaining a constant distance r from the rotation axis X1 to the adjustment reference point W0 between the arm 83 and the operation arm 84. In this case, the operation rod 85 is expanded and contracted to combine a circular movement of the operation arm 84 and a linear movement of the operation rod 85. The deflection yoke 17 is thus rotated about the horizontal axis X0. Note that the adjustment apparatus 80 has a circular interpolation function in order that the rotation of the operation arm 84 and the linear movement of the operation rod 85 are synchronized with each other.

As described above, in the adjustment apparatus 80, the deflection yoke 17 can be automatically adjusted with respect to the neck part 15*a* of the cathode ray tube 15. Therefore, the same advantages as the embodiment previously described can be obtained in the present embodiment.

Note that the present invention is not limited to the embodiments described above but can be variously modified within the range of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A deflection yoke adjustment apparatus for a cathode ray tube, comprising:

detection means for detecting an image projected on the cathode ray tube;

hold means for holding a deflection yoke attached to a neck part of the cathode ray tube; and adjustment means for moving the deflection yoke held by the hold means, based on a detection result depending on the detection means, thereby to automatically adjust a position and an angle of the deflection yoke with respect to the neck part.

2. An apparatus according to claim 1, wherein the adjustment means has a slide mechanism for moving the deflection yoke along a tube axis of the cathode ray tube.

3. An apparatus according to claim 1, wherein the adjustment means has a rotation mechanism for rotating the deflection yoke about a tube axis of the cathode ray tube.

4. An apparatus according to claim 1, further comprising support means for supporting the cathode ray tube such that a tube axis of the cathode ray tube extends in a horizontal direction, wherein the adjustment means has a tilt mechanism for rotating the deflection yoke about a horizontal axis perpendicular to the tube axis of the cathode ray tube.

5. An apparatus according to claim 1, further comprising support means for supporting the cathode ray tube such that a tube axis of the cathode ray tube extends in a horizontal direction, wherein the adjustment means has a yawing mechanism for rotating the deflection yoke about a vertical axis perpendicular to the tube axis of the cathode ray tube.

6. A deflection yoke adjustment apparatus for a cathode ray tube, comprising:

support means for supporting the cathode ray tube such that a tube axis of the cathode ray tube extends in a horizontal direction;

detection means for detecting an image projected from the cathode ray tube supported by the support means;

hold means for holding a deflection yoke attached to a neck part of the cathode ray tube supported by the support means;

a slide mechanism for moving the deflection yoke held by the hold means, along the tube axis, based on a detection result obtained by the detection means;

a rotation mechanism for rotating the deflection yoke held by the hold means, about the tube axis, based on the detection result obtained by the detection means;

a tilt mechanism for rotating the deflection yoke held by the hold means, about a horizontal axis perpendicular to the tube axis, based on the detection result obtained by the detection means; and a yawing mechanism for rotating the deflection yoke held by the hold means, about a vertical axis perpendicular to the tube axis, based on the detection result obtained by the detection means.

7. An apparatus according to claim 6, wherein the rotation mechanism, the tilt mechanism, and the yawing mechanism move the deflection yoke about a point as a center where the tube axis, the horizontal axis, and the vertical axis cross each other.

8. A deflection yoke adjustment method for a cathode ray tube, comprising:

a hold step of holding a deflection yoke attached to a neck part of the cathode ray tube arranged at a predetermined adjustment position;

a detection step of detecting an image projected from the cathode ray tube; and an adjustment step of moving the deflection yoke held in the hold step, based on a detection result obtained by the detection step, thereby to automatically adjust a position and an angle of the deflection yoke with respect to the neck part.

9. A method according to claim 8, wherein the adjustment step includes a step of moving the deflection yoke along a tube axis of the cathode ray tube.

10. A method according to claim 8, wherein the adjustment step includes a step of rotating the deflection yoke about a tube axis of the cathode ray tube.

11. A method according to claim 8, further comprising a support step of supporting the cathode ray tube such that a tube axis of the cathode ray tube extends in a horizontal direction, wherein the adjustment step includes a step of rotating the deflection yoke about a horizontal axis perpendicular to the tube axis of the cathode ray tube.

12. A method according to claim 8, further comprising a support step of supporting the cathode ray tube such that a tube axis of the cathode ray tube extends in a horizontal direction, wherein the adjustment step includes a step of rotating the deflection yoke about a vertical axis perpendicular to the tube axis of the cathode ray tube.

13. A deflection yoke adjustment method for a cathode ray tube, comprising:

a support step of supporting the cathode ray tube at a predetermined adjustment position such that a tube axis of the cathode ray tube extends in a horizontal direction;

a hold step of holding a deflection yoke attached to a neck part of the cathode ray tube supported at the predetermined adjustment position in the support step;

a detection step of detecting an image projected from the cathode ray tube;

a slide step of moving the deflection yoke held in the hold step, along the tube axis, based on a detection result obtained in the detection step;

a rotation step of rotating the deflection yoke held in the hold step, about the tube axis, based on the detection result obtained in the detection step;

a tilt step of rotating the deflection yoke held in the hold step, about a horizontal axis perpendicular to the tube axis, based on the detection result obtained in the detection step; and a yawing step of rotating the deflection yoke held in the hold step, about a vertical axis perpendicular to the tube axis, based on the detection result obtained in the detection step.

14. A method according to claim 13, wherein in the rotation step, the tilt step, and the yawing step, the deflection yoke is moved about a point as a center where the tube axis, the horizontal axis, and the vertical axis cross each other.

* * * * *